United States Patent [19]

Cousar

[11] Patent Number: 4,615,456

[45] Date of Patent: Oct. 7, 1986

[54] COMBINATION BRUSH HOLDER AND TRAY

[76] Inventor: Robert Cousar, 1224 N. Orange Dr., Apt. #13, Hollywood, Calif. 90038

[21] Appl. No.: 784,184

[22] Filed: Oct. 4, 1985

[51] Int. Cl.[4] ..... B65D 25/00

[52] U.S. Cl. ..... 220/90

[58] Field of Search ..... 220/4 A, 90; 222/570, 222/569

[56] References Cited

U.S. PATENT DOCUMENTS 3,744,671 7/1973 Saunders, Jr. ..... 220/90

4,203,537 5/1980 McAlister ..... 220/90

*Primary Examiner*—George T. Hall

[57] ABSTRACT

A combination brush holder and tray with means for holding a brush in an upright position atop a can of paint including a plurality of slots in an inner section thereof through which the paint is allowed to drip back into the can. The preferred embodiment includes means for selectively closing the slots to restrict flow and to use the invention as a paint tray or cleaning vessel. The invention is adapted for the long term storage of painting implements and is readily assembled or disassembled.

8 Claims, 6 Drawing Figures

FIG.2
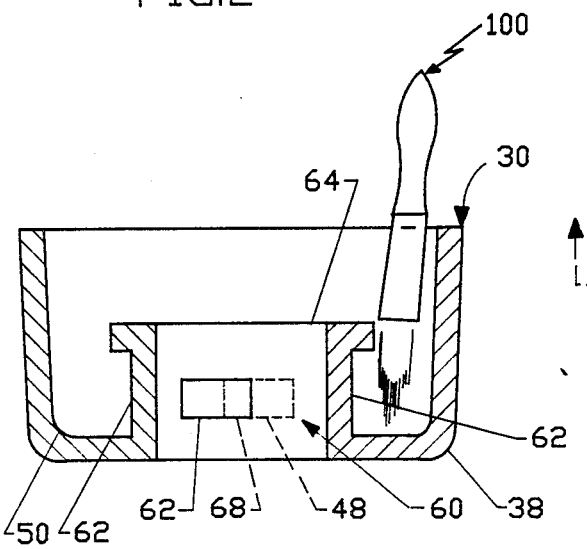
FIG.3
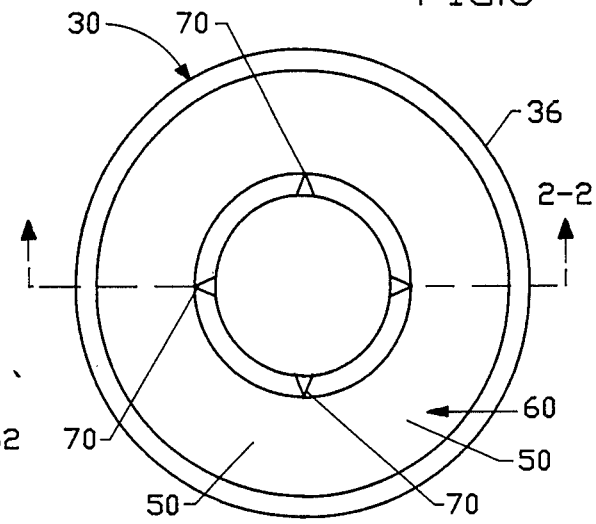
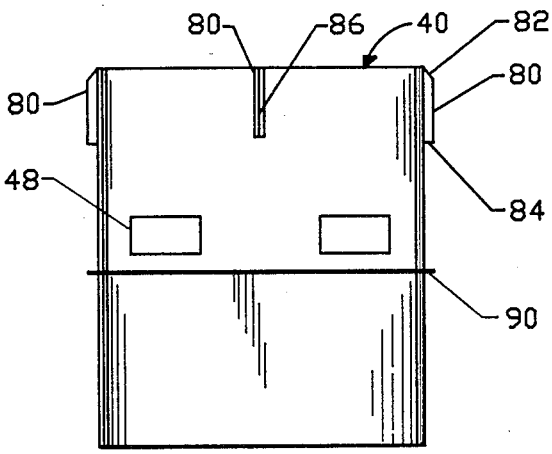
FIG.4
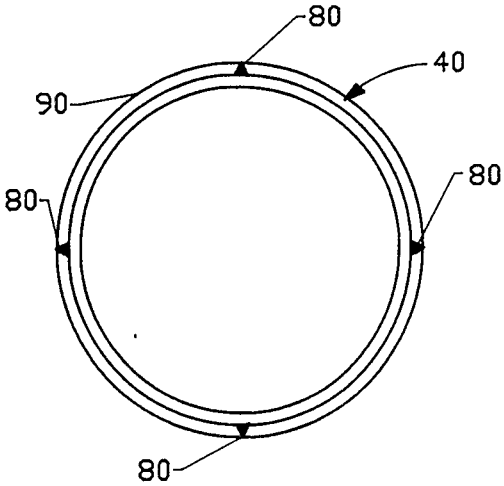
FIG.5
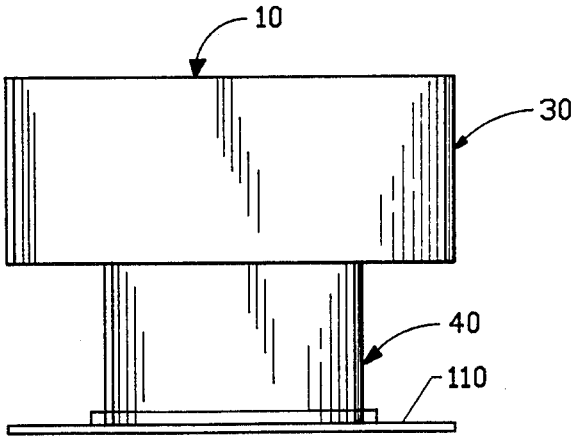
FIG.6

COMBINATION BRUSH HOLDER AND TRAY

BACKGROUND OF THE INVENTION

1. Field of the Invention

This invention relates generally to devices used in painting. More specifically, this invention relates to devices used to hold a paint brush and paint trays.

While the present invention will be described herein with reference to a particular embodiment in a particular application, the invention is not limited thereto. Those having ordinary skill in the art and access to the teachings of the present invention will recognize additional modifications and applications within the scope thereof.

2. Description of the Prior Art

Although spray painting machines are widely used to rapidly paint a surface, it is well recognized that the paint brush is still necessary for trim and surfaces other wise unsuitable for the machine. Although the paint brush is quite handy in many applications, it presents certain problems as well. For example, when the brush is not in use, the painter must find a suitable place to leave it. The chosen location must be free of paint so as not to get paint on the handle of the brush. The chosen location must also be tolerant of paint as the brush will typically leave some paint on the surface.

One common solution to this problem includes placement of the brush on top of the paint can. Unfortunately, this approach is messy as the brush often drips paint down the side of the can and onto the surface on which the can is resting. In addition, the can often has paint on its rim which gets onto the handle of the brush. Paint on the brush often gets onto the painter's hands and ultimately onto some undesired surface. Another problem with the placement of the brush on the paint can is that if the brush is left on the can for a sufficiently long period of time (as is often the case) the paint may dry on the brush. If so, the brush must typically be at least cleaned. In some cases, the brush is ruined. In any event, the result is a costly loss of time and perhaps painting supplies.

Another typical solution to the problem of the brush that is not in use is in the use of newspaper and other similar articles. Here, the painter uses a sheet of newspaper as a resting area for his brushes. However, the brush is typically seldom returned to the same spot on the paper. Over time, paint is all over the paper and soon paint gets on the handle of the brush. As mentioned above, paint on the brush often gets on to the painter's hands and impedes his performance.

Another problem with the use of paper is that the paper tends to increase the speed at which the paint dries on the brush. This is undesireable as for the reasons mentioned above. Further, the paper often becomes soggy and sticks to the brush when it is removed. Removal of the paper from the brush risks the cleanliness of the painter's hands and slows his performance. Finally, paint from the brush often soaks through the paper and contacts the underlying surface i.e., the floor or table on which it is placed.

U.S. Pat. No. 2,630,241 issued to F. C. Schnabel on Mar. 3, 1953 shows a drip tray for paint cans which is intended to eliminate the annoyance and inconvenience of paint drip. This reference provides a disposable tray for the deposit of the brush when it is not in use. FIGS. 2 and 3 of Schnabel show a design in which a trough (3) disposed about the periphery of a paint can is used as a receptacle for the paint brush. Unfortunately, Schnabel's design has some of the same disadvantages as newspaper mentioned above. In particular, if the trough is made of paper as suggested by Schnabel in column 2, lines 16–18, the drying and sticking problems mentioned above are possible. The problem is apparently recognized by Schnabel since in column 2, line 55 thru column 3, lines 1–4 he suggests that the trough should be coated with wax or plastic to prevent soaking the paper trough.

However, the coating of the trough does not solve the problem since the trough is designed to accomodate a brush in the prone position. The coating of the trough will cause the paint from the brush to sit in the trough. The paint may then contaminate the handle of the brush and the hands of the painter in the manner and with the disadvantages discussed above.

There are additional circumstances creating needs not addressed by conventional techniques. For example, when the painter is finished with the brush, a clean area for deposit of the brush is needed. The top of an open can is often used but this is inadequate as any paint on the rim might get on the brush. The top of a closed can is often used however this impedes the movement and storge of the can. Paper is generally inadequate because of the soaking and sticking problems mentioned above.

There is also a need to provide a single receptacle for the soaking of the brush, storage of the brush and the mixing of paint. The provision of a single receptacle for such purposes would reduce the number of objects in the painting area thereby tending to increase the efficiency of the painters while reducing the risks of accidents.

SUMMARY OF THE INVENTION

The shortcomings of the prior art are substantially overcome by the present invention which provides means for holding a paint brush in an upright position when it is not in use and means for returning any drippings from the brush to the paint can. The present invention includes a first cylindrical outer section, a second cylindrical inner section, and a trough therebetween which is designed to hold a brush or other implement in the upright position. The entire assembly is adapted to rest on and partially in a cannister (typically a can of paint).

The invention also includes a plurality of openings in the inner section which paint to flow from the trough to the cannister. The preferred embodiment further includes means for selectively closing the openings to regulate the flow.

To facilitate disassembly, cleaning, and storage, the outer section of the preferred embodiment is grooved and the inner section is fitted with ridges and a rim so that the outer section may slideably engage yet support and be supported by the inner section.

BRIEF DESCRIPTION OF THE DRAWINGS

FIG. 2 is a side view in cross-section along the line 2—2 of FIG. 3 of a portion of the preferred embodiment of the present invention.

FIG. 3 is a top view of a portion of the preferred embodiment of the present invention.

FIG. 4 is a side view of the inner section of the preferred embodiment of the present invention.

FIG. 5 is a top view of the inner section of the preferred embodiment of the present invention.

FIG. 6 is a side view of the present invention.

DESCRIPTION OF THE INVENTION

Figure 1:
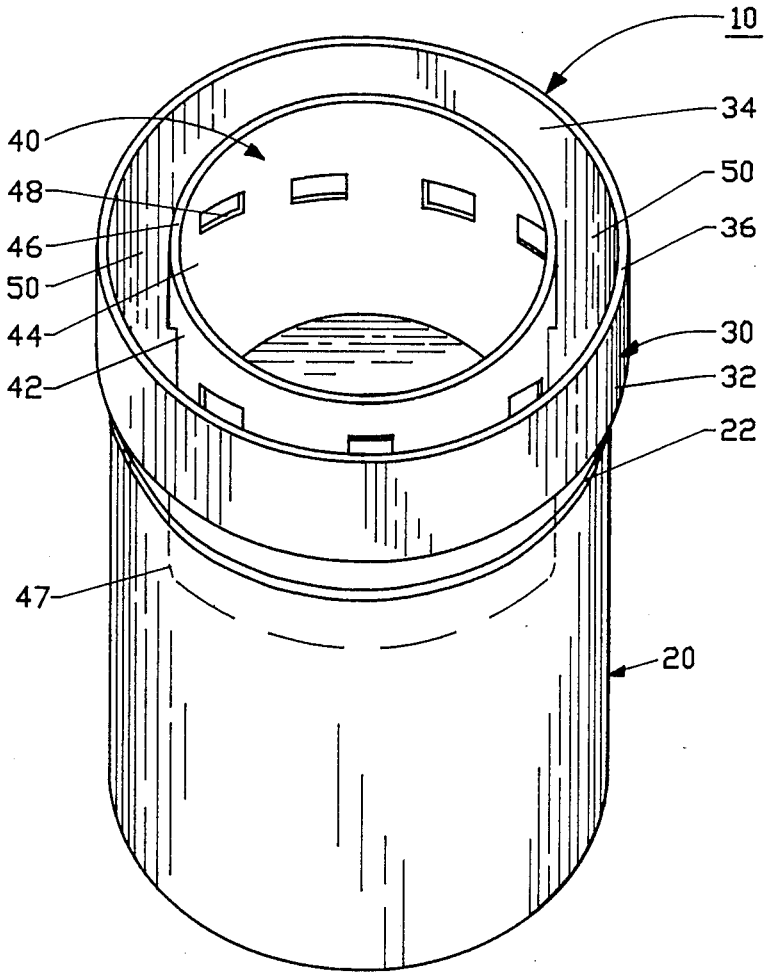
FIG. 1 is a perspective view of an illustrative embodiment of the present invention.

FIG. 1 shows the combination brush holder and tray 10 of the present invention in the operational environment of a paint can 20. The invention 10 includes a first generally cylindrical outer section 30, a second generally cylindrical inner section 40 and a trough 50 therebetween.

The invention 10 may be made of plastic, rubber, metal, wood or other suitable material. While the invention is described with reference to a particular shape, it will be understood by those of ordinary skill in the art that the invention is not limited thereto. The holder and tray 10 may be of any size and shape necessary for a particular application without departing from the true spirit, scope and teachings of the present invention. For example, although the outer section 30 is shown as being generally cylindrical, it could be bowl-shaped or conical or any combination thereof without departing from the scope of the invention.

As shown in FIG. 1, the outer section 30 has an outer wall 32, an inner wall 34 and a rim 36. The outer wall 32 and the inner wall 34 need not be the same shape. The shape of the inner wall 34 is dictated by the nature of the desired side wall of the trough 50 between the outer section 30 and the inner section 40. Similarly, the outer wall 32 may be polygonal (e.g., hexagonal or octagonal) for example to facilitate placement on the can 20 and storage.

The height h of the outer section 30 is determined by the size and shape of the brush 100 (see FIG. 2). That is, in reference to the cross-sectional view of the inner section 30 of FIG. 2 taken along the line 2—2 of the top view of FIG. 3, the height h of the outer section 30 and the width w of the trough 50 are selected so that the length l from the inward edge of the trough to the rim 36 at the top of the inner wall 34 is greater than the distance from the tip of the brush (or implement) 100 to the center of gravity of the brush (or center of mass as the case may be).

Another design consideration relates to the width of the trough 50. That is that the width w of the trough 50 should be sufficiently wide to conveniently accomodate the width of the brush 100 along a chord between the inner section 40 and outer section 30.

Finally, the diameter of the outer section 30 should be greater than that of the cannister 20 to ensure that the combination brush holder and tray 10 can sit atop the cannister 20.

So long as the outer section 30 and trough 50 are designed with these considerations in mind, the holder/tray 10 will sit atop the can and readily accomodate the brush, holding it in the advantageous and convenient upright position.

As shown in FIG. 4, the inner section 40 is a cylinder made of plastic, rubber, metal, wood, or other suitable material. (In the preferred embodiment, the holder/tray of the present invention is made of plastic to minimize costs.) slots should not be so wide as to permit the brush or implement to slide into the cannister 20. The inner section 40 is provided with a plurality of slots 48. In a typical application, four to six slots would be used. The slots 48 allow paint or other fluid to drip or flow from the brush into the cannister 20 via trough 50. In those applications where the drip-through feature is not desired, that is, where the device is used as a tray, the slots 48 may be eliminated.

In the illustrative embodiment of FIG. 1, the inner section 40 may be attached to the outer section 30. The height of the inner section is not critical. In a typical application, the inner section 40 has a height that is twice that of the outer wall 32 of the outer section 30.

FIG. 2 shows an alternative preferred embodiment which incorporates means 60 for selectively closing the openings or slots 48 to inhibit fluid flow from the trough 50 to the canninster 20. (Note that the relative dimensions of the outer section 30, the trough 50 and the means 60 are not in proportion in FIG. 2. The proportions of FIG. 2 are for the purpose of illustration only.) The means 60 is an annular band or rim which is preferably integral and concentric with the trough 50. When the holder/tray 10 is assembled, the means 60 fits circumferentially over the inner section 40. It is of sufficient height to cover the slots 48 on the inner section 40. It is fitted with slots 62 which allow for selective communication of fluid from the trough 50 to the cannister 20 when the band 60 is rotated relative to the inner section 40 until the slots 48 and 62 are in at least partial alignment. While the shape of the slots 62 are not critical, the size should be chosen so that when drip-through is not desired. there hs sufficient surface area on 60 to block the slots 48. One of ordinary skill in the art will recognize that the means 60 cooperate with the slots 48 to create a valve 68 (shown in phantom in FIG. 2) between the trough 50 and the cannister 20 which may be set open, closed, or anywhere therebetween at the will of the operator.

FIG. 4 shows an annular rim 90 on the inner section 40 which is adapted to engage and support the outer section 30 with the attached trough 50 and band 60 of the preferred embodiment of FIG. 2. The rim 90 need not be annular, a plurality of protrusions extending peripherally about the inner section 40 should serve as well. Also shown in FIG. 4 is a plurality of ridges 80 which are attached to the inner section 40 parallel to the longitudinal axis thereof. The upper edge of the ridge 80 is beveled to facilitate placement of the outer section 30 with its corresponding grooves 70 shown in the top view of FIG. 3. The lower edges 84 of the ridges 80 are flat to ensure a good seat against the upper edge 64 of the band 60. The ridges 80 and the rim 90 are seen in the top view of FIG. 5.

FIG. 6 shows the combination brush holder and tray 10 of the present invention in a side view. FIG. 6 shows base 110 into which the inner section 40 fits. The base 110 provides support of the tray 10 when the tray is in storage. The opening of the base 110 is slightly larger in diameter than that of the inner section 40 to allow for a snug fit. The base 110 may be made of plastic or other suitable material.

OPERATION

The combination brush holder and tray 10 of the present invention is capable of many modes of operation. As described in more detail below, the combination brush holder and tray 10 may serve as: (1) a brush holder; (2) a paint or solvent tray; (3) a cleaning vessel; or (4) a convenient storage facility.

As a holder for brushes and other implements, assuming the preferred embodiment of FIG. 2 is being used, the brush holder 10 is first assembled by positioning the outer section 30 so that its longitudinal axis is collinear with the longitudinal axis of the inner section 40 and concentric therewith. Next one section 30 or 40 is held stationary while the other section 40 or 30 is rotated until the grooves 70 of the outer section 30 are in alignment with the ridges 80 of the inner section 40. The inner section 40 is then translated into engagement with the outer section 30 until the outer section 30 comes to rest on the rim 90. The inner and outer sections 30 and 40 are then rotated relatively until the grooves 70 are out of alignment with the ridges 80. The two sections 30 and 40 are counter-rotated further until the desired degree of opening through the band 60 and the slots 48 is acquired. The holder 10 is now inserted into a can 20 of liquid (typically paint) until the underside 38 of the outer section 30 rests on the upper edge 22 of the can 20.

In operation, a brush 100 is inserted into the can through the center of the inner section 40. When the brush 100 is withdrawn, excess paint on the brush 100 may be skimmed off on the upper edge 46 of the inner section 40. This excess paint is returned to the can 20 by the inner surface 44 of the section 40.

When the brush 100 is not in use it may be placed in the trough 50 in an upright position as shown FIG. 2. Any excess paint will drip from the brush 100 into the trough 50. If there is enough paint, it will flow into the can 20 via the slots 62 and 48 and the inner surface 44 if the valve 68 is open. (It should be noted here that the shape of the trough 50 and the relative dimensionality of the brush 100 and the holder 10 depicted in FIG. 2 is for the purpose of illustration only. The actual shape of the trough 50 and the relative dimensionality of the brush 100 and holder 10 should be set in accordance with the parameters as taught above.)

As a paint or solvent tray, the holder/tray 10 is assembled as above except the sections 30 and 40 are adjusted so that the valve 68 through slots 62 and 48 is closed. Any combination of liquids and solvents may be placed in the trough 50 for mixing, direct application, cleaning, or other applications.

As a cleaning vessel, the valve 68 is closed and the trough 50 is filled with cleaning solvent. The brush to be cleaned is placed in the trough 50 with the solvent and manipulated or swirled as necessary to effect a cleaning of the brush.

As a storage facility, the holder/tray 10 may remain disassembled. Brushes or other implements may be placed in the trough 50 for storage.

While particular embodiments have been described with reference to particular applications, those of ordinary skill in the art additional embodiments, modifications, and applications within the scope of the invention. The appended claims are intended to cover any and all such embodiments, modifications, and applications.

What is claimed is:

1. An apparatus for supporting an implement, which is customarily used in an operation to apply liquid to a surface, in close proximity to a cannister for retention of said liquid, said apparatus comprising:

a first cylindrical outer section;

a second cylindrical inner section disposed substantially concentrically within the outer section and having a diameter less than or equal to that of said cannister; and a third section disposed between said first and second sections and adapted to provide a trough between said first, second and third sections for the retention of said implement in an upright position.

2. The apparatus of claim 1 wherein said second surface includes a plurality of openings to allow fluid to flow from said trough to said cannister.

3. The apparatus of claim 2 further including means for selectively closing said openings to inhibit fluid flow from said trough to said cannister.

4. The apparatus of claim 3 wherein said means for selectively closing said openings is a fourth annular surface circumferentially disposed relative to said second section to selectively close the openings therein.

5. The apparatus of claim 4 wherein said fourth surface is at least partially perforated to permit fluid flow from said trough through said second section into said cannister.

6. The apparatus of claim 5 whenein said fourth surface is attached to said third section.

7. The apparatus of claim 6 wherein said third section is attached to said first section.

8. The apparatus of claim 7 wherein said second section includes a rim about the periphery thereof which engages and supports said first, third and fourth sections.

* * * * *